US007666345B2

(12) United States Patent
Robertson et al.

(10) Patent No.: US 7,666,345 B2
(45) Date of Patent: Feb. 23, 2010

(54) METHOD AND APPARATUS FOR MELTING METAL

(75) Inventors: Thomas F. Robertson, Medina Township, OH (US); John N. Newby, Lexington, KY (US)

(73) Assignee: Fives North American Combustion, Inc., Cleveland, OH (US)

( * ) Notice: Subject to any disclaimer, the term of this patent is extended or adjusted under 35 U.S.C. 154(b) by 0 days.

(21) Appl. No.: 12/202,451

(22) Filed: Sep. 2, 2008

(65) Prior Publication Data

US 2009/0020051 A1 Jan. 22, 2009

Related U.S. Application Data

(62) Division of application No. 11/176,465, filed on Jul. 7, 2005, now Pat. No. 7,452,400.

(51) Int. Cl.
*C21D 9/56* (2006.01)

(52) U.S. Cl. ..... 266/44; 266/249; 431/10

(58) Field of Classification Search ..... 266/44, 266/249, 268; 431/8, 10
See application file for complete search history.

(56) References Cited

U.S. PATENT DOCUMENTS

| | | | |
|---|---|---|---|
| 3,345,054 | A | 10/1967 | Andonjev at al. |
| 4,000,962 | A | 1/1977 | Hemingway et al. |
| 4,818,844 | A | 4/1989 | Ward |
| 4,828,483 | A | 5/1989 | Finke |
| 4,923,391 | A | 5/1990 | Gitman |
| 5,180,300 | A | 1/1993 | Hovis et al. |
| 5,267,850 | A | 12/1993 | Kobayashi et al. |
| 5,314,170 | A | 5/1994 | Tada et al. |
| 5,683,238 | A | 11/1997 | Snyder |
| 5,876,197 | A | 3/1999 | Engelberg et al. |
| 5,921,771 | A | 7/1999 | Kobayashi |
| 6,007,761 | A | 12/1999 | Nakagawa et al. |
| 6,234,789 | B1 | 5/2001 | Miyata |
| 6,250,917 | B1 | 6/2001 | Engelberg et al. |
| 6,368,379 | B1 | 4/2002 | Tateishi et al. |
| 6,495,092 | B1 | 12/2002 | Hazama et al. |
| 7,452,400 | B2 * | 11/2008 | Robertson et al. ..... 75/414 |

FOREIGN PATENT DOCUMENTS

WO WO 2004063403 A1 * 7/2004

OTHER PUBLICATIONS

International Search Report dated Feb. 12, 2007.
North American Combustion Handbook, A Practical Basic Reference on the Art and Science of Industrial Heating with Gaseous and Liquid Fuels, Third Edition, vol. II,1997 iii, iv, pp. 133-137, Dec. 1997.

* cited by examiner

*Primary Examiner*—Scott Kastler
(74) *Attorney, Agent, or Firm*—Jones Day

(57) ABSTRACT

An apparatus for melting a metal load includes a furnace having a melting chamber with a hearth and a molten metal outlet. The apparatus further includes non-regenerative burners that are operative to fire into the melting chamber, and regenerative burners that also are operative to fire into the melting chamber. The method includes the steps of firing non-regenerative burners into the chamber to provide heat for melting the load, and also firing regenerative burners into the chamber to provide heat for melting the load.

26 Claims, 2 Drawing Sheets

METHOD AND APPARATUS FOR MELTING METAL

RELATED APPLICATIONS

This is a divisional application claiming the benefit of U.S. patent application Ser. No. 11/176,465, filed Jul. 7, 2005 now U.S. Pat. No. 7,452,400.

TECHNICAL FIELD

This technology relates to furnaces for melting metal.

BACKGROUND

Pieces of aluminum or other metals can be melted by placing a load of the metal pieces in a furnace, and by firing burners so that the burner output impinges on the load. The melting process proceeds in two phases. In the first phase, gradual melting causes a molten bath to form and rise at the bottom of the load. Solid pieces of metal become submerged as the melting load descends into the rising molten bath. This is followed by the second phase of the process, in which the burners continue to fire into the space above the molten bath after the load becomes fully submerged. This provides heat that must be transferred to the submerged solids to ensure that the entire load becomes melted.

SUMMARY

The claimed invention provides a method and apparatus for melting a metal load. The apparatus comprises a furnace having a melting chamber with a hearth and a molten metal outlet. The apparatus further comprises non-regenerative burners that are operative to fire into the melting chamber, and regenerative burners that also are operative to fire into the melting chamber. The method comprises the steps of firing non-regenerative burners into the melting chamber to provide heat for melting the load, and also firing regenerative burners into the chamber to provide heat for melting the load.

Additionally, the claimed invention provides a method of retrofitting a melting furnace by installing burners as needed for the furnace to have both regenerative and non-regenerative burners.

DETAILED DESCRIPTION

Figure 1:
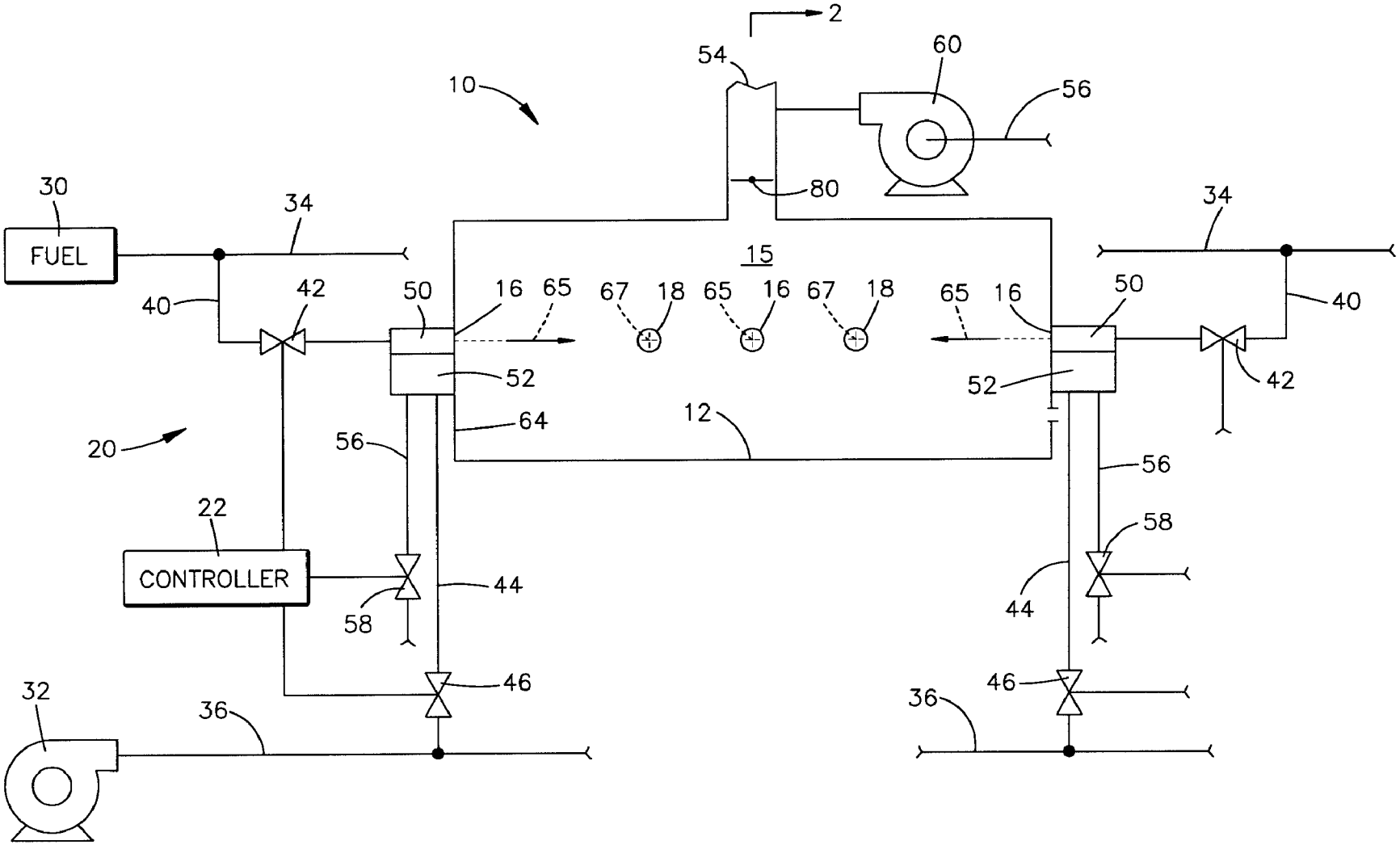
FIG. 1 is a schematic view of a furnace with a melting chamber, burners that are operative to fire into the melting chamber, and a reactant supply and control system that is operative to control the burners.

The structure 10 shown schematically in the drawings can be operated in steps that are examples of the elements recited in the method claims, and has parts that are examples of the elements recited in the apparatus claims. The illustrated structure 10 thus includes examples of how a person of ordinary skill in the art can make and use the claimed invention. It is described here to meet the enablement and best mode requirements of the patent statute without imposing limitations that are not recited in the claims.

This particular apparatus 10 is an aluminum melting furnace with a hearth 12 in a melting chamber 15. The furnace 10 has burners, including both regenerative burners 16 and non-regenerative burners 18, that are fired into the melting chamber 15 to provide heat for melting an aluminum load on the hearth 12. The furnace 10 also has a reactant supply and control system 20 that includes a controller 22. In operation, the burners 16 and 18 are fired with reactant streams of fuel and oxidant under the influence of the controller 22. This provides heat for melting the aluminum load in a manner directed by the controller 22. The various parts of the furnace 10, as shown, described and claimed, may be of either original or retrofitted construction as required to accomplish any particular implementation of the invention.

A fuel source 30, which is preferably a supply of natural gas, and an oxidant source 32, which is preferably an air blower, provide streams of those reactants along respective supply lines 34 and 36 in the reactant supply and control system 20. Each regenerative burner 16 communicates with the fuel supply line 34 through a branch line 40 with a fuel control valve 42. Each regenerative burner 16 also communicates with the oxidant supply line 36 through a branch line 44 with an oxidant control valve 46.

As shown schematically in FIG. 1, fuel is delivered directly to the nozzle portions 50 of the regenerative burners 16. Oxidant is delivered directly to the regenerative beds 52 which, in turn, direct the oxidant to the nozzles 50 in a preheated state. The regenerative beds 52 communicate with a flue 54 through exhaust lines 56 and exhaust valves 58. An exhaust fan 60 pulls the exhaust gases from the exhaust lines 56 into the flue 54.

Figure 2:
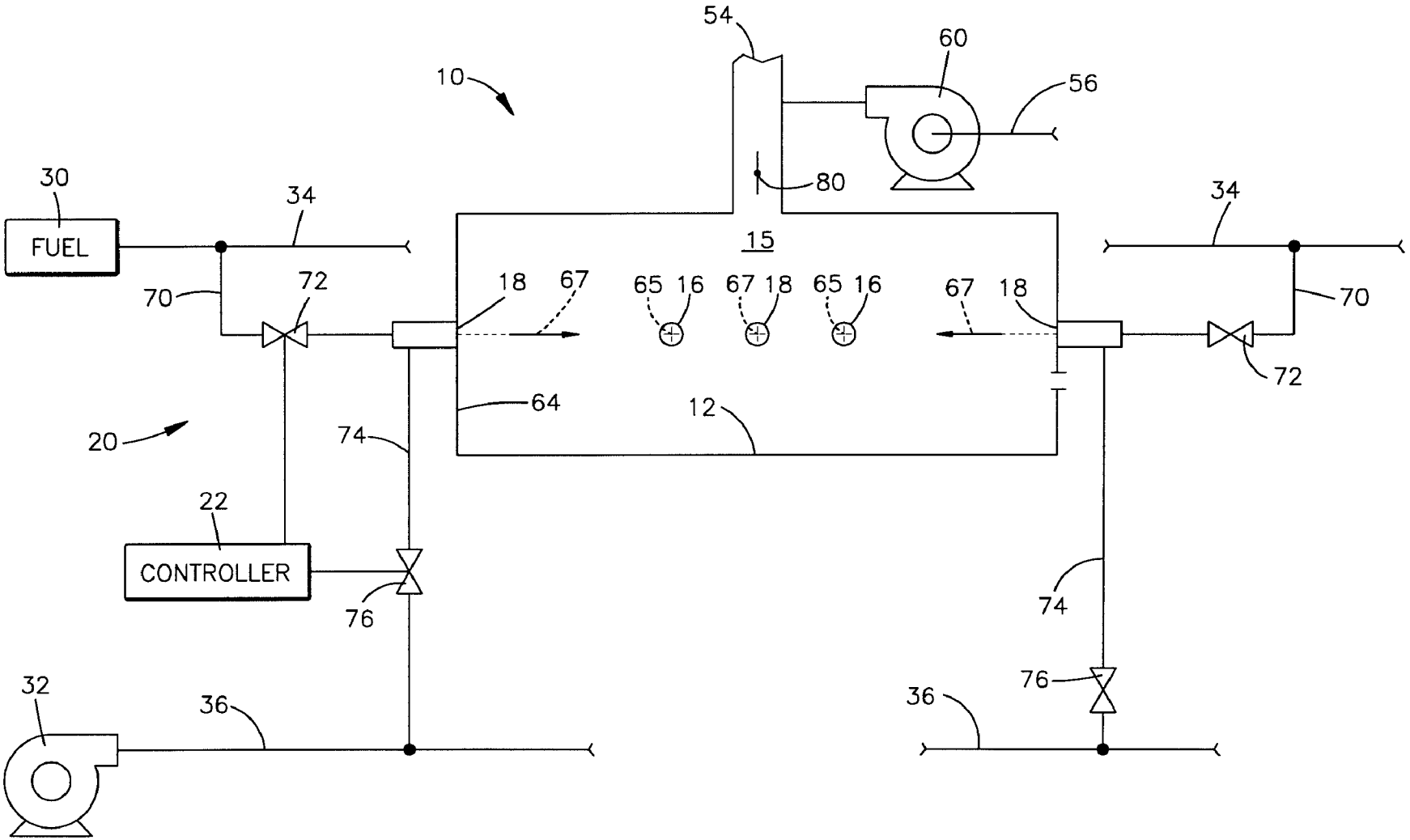
FIG. 2 is a schematic view taken generally on line 2-2 of FIG. 1.

The melting chamber 15 may have any suitable configuration, but for clarity of illustration the melting chamber 15 shown schematically in the drawings has a circular configuration with a cylindrical side wall 64. As shown by comparison of FIGS. 1 and 2, the regenerative burners 16 and the non-regenerative burners 18 have alternating positions in an array extending around the side wall 64 of the melting chamber 15. The regenerative burners 16 in this example are arranged in opposed pairs that fire into the chamber 15 in opposite directions, as indicated by the opposed pair of arrows 65 shown for example in FIG. 1. The non-regenerative burners 18 in this example also are arranged in opposed pairs that fire into the chamber 15 in opposite directions, as indicated by the opposed pair of arrows 67 shown for example in FIG. 2. As further shown in FIG. 2, each non-regenerative burner 18 communicates with the fuel supply line 34 through a branch line 70 with a fuel control valve 72, and communicates with the oxidant supply line 36 through a branch line 74 with an oxidant control valve 76.

The controller 22 is operatively associated with the fuel control valves 42 and 72, the oxidant control valves 46 and 76, and the exhaust valves 58, and has hardware and/or software configured for operation of the burners 16 and 18. As the controller 22 carries out those instructions, it actuates the various valves to initiate, regulate and terminate flows of reactant and exhaust streams that cause the burners 16 and 18 to fire into the melting chamber 15 in a controlled manner. The controller 22 shown schematically in the drawings may thus comprise any suitable programmable logic controller or other control device, or combination of control devices, that is programmed or otherwise configured to perform as recited in the claims. If the furnace 10 is retrofitted in accordance with that aspect of the claimed invention, the claimed controller could be provided by replacing, supplementing and/or adapting an existing controller.

When the non-regenerative burners 18 are to be fired, the controller 22 initiates and regulates reactant streams that flow to those burners 18 through their fuel and oxidant control valves 72 and 76. A damper 80 in the flue 54 is actuated by the controller 22 as needed to exhaust flue gases from the chamber 15 when the non-regenerative burners 18 are fired.

The regenerative burners 16 can be fired in either a regenerative or non-regenerative manner. When fired in a regenerative manner, their fuel and oxidant control valves 42 and 46 are cycled between open and closed conditions to alternate between the two burners 16 in each opposed pair. In this manner, the first burner 16 in a pair is fired while the second burner 16 in the pair is not fired. The second burner 16 in the pair is subsequently fired while the first is not. The exhaust valves 58 are cycled so that exhaust gases from the melting chamber 15 are pulled through the regenerative beds 52 of the non-firing burners 16 under the influence of the exhaust fan 60. Additionally, the controller 22 operates the flue damper 80 to establish a desired pressure condition in conjunction with exhaust flow through the regenerative beds 52. This enables the regenerative beds 52 to accumulate heat during the non-firing portions of the cycles. The accumulated heat is available to preheat the oxidant that is delivered to the regenerative beds 52 from the oxidant branch lines 44 during the firing portions of the cycles.

When the regenerative burners 16 are fired in a non-regenerative manner, they are not cycled into and out of exhaust conditions. Although they are fired with streams of oxidant that flow to the nozzles 50 through the regenerative beds 52, there is no accumulation of heat transferred from exhaust gases to the beds 52. Non-regenerative firing of the regenerative burners 16 in this manner is known as direct firing.

In operation of the furnace 10, a load of aluminum is melted by first placing the solid pieces in a pile on the hearth 12. The burners 16 and 18 are then fired into the melting chamber 15, and the melting process proceeds in two phases. In the first phase, gradual melting of the aluminum causes a molten bath to form and rise at the bottom of the load. Solid pieces of aluminum become submerged as the melting load descends into the rising molten bath. In the second phase, melting is completed as the submerged solids become fully melted within the molten bath.

The burners 16 and 18 can be operated in distinct modes that are performed in a program to optimize the two-phase melting process. In one example, the burners 16 and 18 are operated in three successive modes. The first mode uses only the non-regenerative burners 18. This initiates the first of the two melting phases described above. The second mode uses the regenerative burners 16 in addition to non-regenerative burners 18. This completes the first melting phase. The third mode uses only the regenerative burners 16. This occurs in the second melting phase.

Specifically, in this example the controller 22 conducts the first mode of operation by directing streams of reactants through the fuel and oxidant control valves 72 and 76 for the non-regenerative burners 18. The controller 22 also actuates the flue damper 80 in a range of open conditions. However, the fuel and oxidant control valves 42 and 46 for the regenerative burners 16 are maintained in closed conditions so that only the non-regenerative burners 18 are provided with reactant streams of fuel and oxidant to fire into the melting chamber 15 as the first phase of the melting process begins.

The second operating mode, which in this example uses regenerative burners 16 along with non-regenerative burners 18, optimizes the end of the first melting phase as the aluminum pieces melt downward into the molten bath and the furnace temperature rises significantly. The higher thermal efficiency of the regenerative burners 16 then becomes more suitable. In this example the controller 22 initiates the second mode of operation by initiating cycles of opening and closing at the fuel control valves 42, the oxidant control valves 46, and the exhaust valves 58 for the regenerative burners 16. This occurs while the fuel and oxidant control valves 72 and 76 for the non-regenerative burners 18 remain open. Simultaneous firing of the non-regenerative burners 18 with alternating pairs of regenerative burners 16 then proceeds throughout the remainder of the first melting phase as the melting load descends into the molten bath. The controller 22 can regulate the reactant streams and firing cycles to increase the amount of heat provided by the regenerative burners 16, and/or to decrease the amount of heat provided by the non-regenerative burners 18, during the second mode of burner operation.

The third mode of burner operation is performed during the second melting phase. When the second melting phase begins, all small pieces of aluminum that might otherwise be subject to lofting have descended into the molten bath, making the load less subject to potential negative effects of the regenerative burners 16 firing into the space above the molten bath. Also, the absence of airborne droplets and particulates above the molten bath is favorable for the regenerative burners 16 because such droplets and particulates could be drawn into the regenerative beds 52 during the exhaust cycles.

When shifting from the second to the third mode of operation, the controller 22 shifts the fuel and oxidant control valves 72 and 76 for the non-regenerative burners 18 from open to closed conditions. The fuel and oxidant control valves 42 and 46 for the regenerative burners 16 continue to be cycled between open and closed conditions to alternate firing between the two burners 16 in each opposed pair. Melting is completed in the third mode as the molten bath is brought to a uniform temperature under the influence of the relatively high peak flame temperatures of the regenerative burners 16.

In the example described above, the controller 22 is configured to fire only the non-regenerative burners 18 in the first mode of operation. In a different example, the controller 22 is similarly configured to fire the non-regenerative burners 18 in the first mode, but also to direct-fire the regenerative burners 16 in the first mode. The first mode is followed by a hybrid second mode in which the regenerative burners 16 are shifted from the direct-fired manner of operation to the regenerative manner of operation with alternating exhaust cycles. This is accomplished by shifting at least one pair of regenerative burners 16 into the regenerative manner of operation while at least one non-regeneration burner is being fired. Preferably, the number of cycled pairs of regenerative burners 16 is increased during the hybrid mode. It is also preferable to decrease the number of non-regenerative burners 18 that are fired during the hybrid mode. This provides a transition from the direct-fired first mode to a fully regenerative third mode for the final melting phase.

This written description sets forth the best mode of carrying out the invention, and describes the invention so as to enable a person skilled in the art to make and use the invention, by presenting examples of the elements recited in the claims. The patentable scope of the invention is defined by the claims, and may include other examples that occur to those skilled in the art. Other examples of operational modes for the burners 16 and 18 could include different sequences of combining, shifting between, and/or alternating or repeating the conditions of direct-fired and regenerative operation of the burners 16 and 18 in view of melting chamber flow paths or other conditions that arise during melting of the load on the hearth 12. Such other examples are intended to be within the scope of the claims if they have structural or process elements that do not differ from the literal language of the claims, or if they have equivalent structural or process elements with insubstantial differences from the literal language of the claims.

The invention claimed is:

1. A method of retrofitting a furnace having a melting chamber with a hearth, a molten metal outlet, and a plurality of non-regenerative burners that are operative to fire into the melting chamber, said method comprising:

installing a plurality of regenerative burners that are operative to fire into the melting chamber.

2. A method as defined in claim 1 further comprising the step of providing a reactant supply and control system including a controller that is configured to fire the burners in differing modes including a mode in which reactant streams of fuel are prevented from flowing to the regenerative burners while the non-regenerative burners are being fired.

3. A method as defined in claim 1 further comprising the step of providing a reactant supply and control system including a controller that is configured to fire the burners in differing modes including a mode in which regenerative burners and non-regenerative burners are fired simultaneously.

4. A method as defined in claim 1 further comprising the step of providing a reactant supply and control system including a controller that is configured to fire the burners in differing modes including a first mode in which only non-regenerative burners are fired, a second mode in which non-regenerative burners and regenerative burners are fired simultaneously, and a third mode in which only regenerative burners are fired.

5. A method as defined in claim 4 wherein the controller is configured to provide the first mode early in an initial melting phase, to provide the second mode later in the initial melting phase, and to provide the third mode in a final melting phase following the initial melting phase.

6. A method of retrofitting a furnace having a melting chamber with a hearth, a molten metal outlet, and a plurality of regenerative burners that are operative to fire into the melting chamber, said method comprising:

installing a plurality of non-regenerative burners that are operative to fire into the melting chamber.

7. A method as defined in claim 6 further comprising the step of providing a reactant supply and control system including a controller that is configured to fire the burners in differing modes including a mode in which reactant streams of fuel are prevented from flowing to the regenerative burners while the non-regenerative burners are being fired.

8. A method as defined in claim 6 further comprising the step of providing a reactant supply and control system including a controller that is configured to fire the burners in differing modes including a mode in which regenerative burners and non-regenerative burners are fired simultaneously.

9. A method as defined in claim 6 further comprising the step of providing a reactant supply and control system including a controller that is configured to fire the burners in differing modes including a first mode in which only non-regenerative burners are fired, a second mode in which non-regenerative burners and regenerative burners are fired simultaneously, and a third mode in which only regenerative burners are fired.

10. A method as defined in claim 9 wherein the controller is configured to provide the first mode early in an initial melting phase, to provide the second mode later in the initial melting phase, and to provide the third mode in a final melting phase following the initial melting phase.

11. A method of retrofitting a furnace having a melting chamber with a hearth, a molten metal outlet, and a plurality of non-regenerative burners that are operative to fire into the melting chamber, said method comprising:

installing a plurality of regenerative burners that are operative to fire into the melting chamber; and providing a reactant supply and control system including a controller that is configured to fire the burners in differing modes including a) a direct-fired mode in which regenerative burners are fired without exhaust cycles while non-regenerative burners also are being fired, and b) a hybrid mode in which at least two regenerative burners are fired with alternating exhaust cycles while a non-regenerative burner also is being fired.

12. A method as defined in claim 7 wherein the controller is configured to change the number of non-regenerative burners that are fired during the hybrid mode.

13. A method as defined in claim 12 wherein the controller is configured to decrease the number of non-regenerative burners that are fired during the hybrid mode.

14. A method as defined in claim 11 wherein the controller is configured to change the number of cycled regenerative burners during the hybrid mode.

15. A method as defined in claim 14 wherein the controller is operative to increase the number of cycled regenerative burners during the hybrid mode.

16. A method as defined in claim 11 wherein the controller is configured to provide the direct firing mode early in an initial melting phase, and to provide the hybrid mode later in the initial melting phase.

17. A method as defined in claim 16 wherein the differing modes further include a fully regenerative mode in which no non-regenerative burners are fired, and regenerative burners are fired in pairs with alternating exhaust cycles.

18. A method as defined in claim 17 wherein the controller is configured to provide the fully regenerative mode in a final melting phase following the initial melting phase.

19. A method of retrofitting a furnace having a melting chamber with a hearth, a molten metal outlet, and a plurality of regenerative burners that are operative to fire into the melting chamber, said method comprising:

installing a plurality of non-regenerative burners that are operative to fire into the melting chamber; and providing a reactant supply and control system including a controller that is configured to fire the burners in differing modes including a) a direct-fired mode in which regenerative burners are fired without exhaust cycles while non-regenerative burners also are being fired, and b) a hybrid mode in which at least two regenerative burners are fired with alternating exhaust cycles while a non-regenerative burner also is being fired.

20. A method as defined in claim 19 wherein the controller is configured to change the number of non-regenerative burners that are fired during the hybrid mode.

21. A method as defined in claim 20 wherein the controller is configured to decrease the number of non-regenerative burners that are being fired during the hybrid mode.

22. A method as defined in claim 19 wherein the controller is configured to change the number of cycled regenerative burners during the hybrid mode.

23. A method as defined in claim 22 wherein the controller is configured to increase the number of cycled regenerative burners during the hybrid mode.

24. A method as defined in claim 19 wherein the controller is configured to provide the direct firing mode early in an initial melting phase, and to provide the hybrid mode later in the initial melting phase.

25. A method as defined in claim 24 wherein the differing modes further include a fully regenerative mode in which no non-regenerative burners are fired, and regenerative burners are fired in pairs with alternating exhaust cycles.

26. A method as defined in claim 25 wherein the controller is configured to provide the fully regenerative mode in a final melting phase following the initial melting phase.

* * * * *